US008240072B2

(12) United States Patent
Frey

(10) Patent No.: US 8,240,072 B2
(45) Date of Patent: Aug. 14, 2012

(54) GROOVE-MOUNT FABRIC DISPLAY SYSTEM WITH TWO-PART FRAME

(75) Inventor: Robert M. Frey, Salt Lake City, UT (US)

(73) Assignee: Moss, Inc., Salt Lake City, UT (US)

( * ) Notice: Subject to any disclaimer, the term of this patent is extended or adjusted under 35 U.S.C. 154(b) by 220 days.

(21) Appl. No.: 12/702,220

(22) Filed: Feb. 8, 2010

(65) Prior Publication Data

US 2011/0192556 A1 Aug. 11, 2011

(51) Int. Cl.
*G09F 17/00* (2006.01)

(52) U.S. Cl. ..... 40/603

(58) Field of Classification Search ..... 40/603, 40/604; 160/371, 377, 378, 379, 380, 391, 160/395, 591; 38/102, 102.1, 102.9
See application file for complete search history.

(56) References Cited

U.S. PATENT DOCUMENTS 1,137,702 A * 4/1915 Crawfod ..... 160/377
1,734,710 A * 11/1929 Borchert ..... 72/370.23
4,603,724 A * 8/1986 Borwick ..... 160/180
4,723,367 A * 2/1988 Samoilov et al. ..... 38/102.2
4,833,805 A * 5/1989 Roberson ..... 40/603
4,937,961 A * 7/1990 Gandy et al. ..... 40/603
5,881,525 A * 3/1999 Riegelman et al. ..... 52/656.7
5,893,227 A * 4/1999 Johansson et al. ..... 40/603
6,701,996 B1 * 3/2004 Chen ..... 160/135
6,886,300 B2 * 5/2005 Hudoba et al. ..... 52/222
2006/0042141 A1 3/2006 Hansen et al.
2010/0202827 A1 8/2010 Frey

* cited by examiner

*Primary Examiner* — Lesley D Morris
*Assistant Examiner* — Christopher E Verraa
(74) *Attorney, Agent, or Firm* — Lance M. Pritikin

(57) ABSTRACT

A groove-mount fabric display system with two-part frame comprises an outer frame element, an insert frame element and one or two flexible display panels. The two-part frame is quickly assembled by inserting and deploying the insert frame element within the rigid outer frame element. The frame elements can be manufactured from flat stock materials which are relatively inexpensive to purchase and shape. The interface of the frame elements forms one or more grooves near the perimeter of the resulting two-part frame. The grooves accept mounting gaskets connected at the peripheries of each display panel. Embodiments may include one or more internally-positioned compression tubes to help maintain internal structural rigidity and the integrity of the grooves. What results is a more cost-effective, robust, three-dimensional display capable of supporting fabric display panels in tension over extended periods of use.

7 Claims, 6 Drawing Sheets

GROOVE-MOUNT FABRIC DISPLAY SYSTEM WITH TWO-PART FRAME

RELATED APPLICATIONS

Not Applicable.

TECHNICAL FIELD OF THE INVENTION

The present invention relates generally to the field of graphic display systems. More particularly, the invention concerns graphic display systems comprising a framework to which flexible display panels are attached, such as those commonly used for decoration and advertising in retail establishments, trade shows, and the like.

BACKGROUND OF THE INVENTION

The use of fabric as a graphic display substrate is gaining popularity in the retail environment due to its aesthetically pleasing quality and ease of storage and shipping. However, relying on conventional methods for creating specialized frame members of various sizes and shapes for individual retail applications using fabric as a display medium can be costly and time-consuming. Retail display environments typically require lower-cost solutions that can be manufactured in a relatively short lead time.

Display systems for retail environments typically consist of a series of outer frame members that are assembled to define the general size and shape of the display. The opening or interior space created by the frame is then typically filled or covered with a rigid or flexible panel which acts as a substrate for a graphic design. The attachment of the display panels to the outer frame commonly results in a solid three-dimensional shape. One example of a flexible display panel has been used previously in association with groove-mount fabric display systems. Groove-mount fabric display systems typically incorporate a perimeter groove integrally formed within each of the outer frame members. In such systems, the groove is oriented perpendicularly to the intended front face of the fabric panel, and serves as an attachment point for support of the fabric panel by accepting one or more mounting gaskets that are affixed to the perimeter edges of the fabric panel.

A disadvantage of the typical prior groove frame system is that the groove is integrally formed within each of the outer frame members, generally requiring the creation of specialized metal extrusions for use as the individual frame members. Specialized extrusions are significantly more costly to produce than standard flat metal stock shapes, particularly when such extrusions must be adapted for use in generating various framework shapes, sizes and angles. Further, these prior systems typically require additional hardware or numerous welding operations to interconnect the metal extrusions to form a completed framework. Although those in the art recognize the need for a faster and less-expensive solution, significant challenges are presented when attempting to rely on flat-stock shapes and less-expensive materials to produce a framework rigid enough to stand up to aggressive handling in the retail environment while also providing a groove resilient enough to continuously support a fabric panel in tension for several months or years.

Accordingly, what is needed is a robust, low-cost groove-mount fabric display system which can take on a variety of shapes and sizes, leverage low-cost construction materials and faster manufacturing processes, and provide sufficient structural rigidity to support fabric display panels in tension for extended periods of time within the retail environment.

SUMMARY OF THE INVENTION

By way of summary, embodiments concern a groove-mount fabric display system comprising an outer frame element, an insert frame element and at least a first display panel. The outer frame element has a main axis, a multiplicity of sides distributed thereabout, an inboard surface and a first peripheral edge. Depending on the embodiment, the sides can be planar or curved. The sides are thin-walled and generally define the lateral periphery of a cavity. The cavity has a first axial opening, and in some embodiments, a second axial opening as well. In embodiments in which the outer frame element has a second axial opening, the outer frame also has a second peripheral edge.

The insert frame element has a substrate portion and a spacer portion, each typically being thin-walled and in fixed association with each other. The insert frame element is adapted to be axially inserted into the cavity and placed in a deployed configuration. When the insert frame member is in its deployed configuration, the spacer portion is generally disposed between the substrate portion and the inboard surface of the outer frame element, thereby forming a first groove generally proximate the first peripheral edge, and, in certain embodiments having a second axial opening, forming a second groove generally proximate the second peripheral edge. The first groove and second groove each open in substantially the axial direction, that is, in a direction generally parallel with the main axis of the outer frame element.

The first display panel has a first display portion and a first mounting gasket flexibly connected thereto. The first display portion is substantially flexible, and can be comprised of fabric or other flexible material suitable for use as a substrate upon which graphics can be mounted, printed or projected. The first mounting gasket is adapted to be inserted into the first groove, thereby supporting the first display portion in tension across the first axial opening.

Certain embodiments further comprise a first compression tube, which is generally elongated with two first opposed ends. The first compression tube is adapted to be snugly positioned within the cavity such that one or both first opposed ends continuously urge the inner frame element toward the inboard surface. Embodiments with a first compression tube may also comprise a second compression tube which is elongated with two second opposed ends. The second compression tube is also adapted to be snugly positioned within the cavity, typically at approximately a right angle to the first compression tube such that one or both second opposed ends continuously urge the inner frame element toward the inboard surface. To provide further aid in urging the inner frame element toward the inboard surface, additional such compression tubes may be used. The additional compression tubes can either be positioned in parallel or at various angles with respect to each other, typically depending on the overall shape or number of sides of the display system.

In embodiments, the spacer portion has a spacer thickness, and the first groove and second groove have a first groove width and second groove width, respectively. In certain embodiments, the first and second groove widths are generally defined by the spacer thickness. In addition, the first and second grooves of certain embodiments extend along substantially the entire length of the first peripheral edge and second peripheral edge, respectively.

In most embodiments, the outer frame element is substantially formed of flat stock of a material such as metal and plastic. Typically, the insert frame element is substantially formed of a material such as wood, cardboard, light-gauge plastic or sheet metal.

In particular embodiments, the substrate portion is comprised of a plurality of substrate segments in hinged association with one another. In such an embodiment, each substrate segment typically corresponds to a separate side of the outer frame element. The hinged association generally allows the insert frame element to be moved between a generally planar precursor configuration and the aforementioned deployed configuration. It is also common in such embodiments for the spacer portion to be comprised of a plurality of spacer segments, each spacer segment corresponding to a separate substrate segment. Similarly, the first mounting gasket may be comprised of a plurality of first gasket segments, each corresponding to a separate side of the outer frame element.

In certain embodiments in which the outer frame member has a second peripheral edge, the cavity has a second axial opening, and a second groove is formed when the insert frame element is in deployed configuration, the embodiment may also comprise a second display panel. The second display panel has a second display portion and a second mounting gasket flexibly connected thereto. The second display portion is substantially flexible, and can be comprised of fabric or other flexible material suitable for use as a substrate upon which graphics can be mounted, printed or projected. The second mounting gasket is adapted to be inserted into the second groove, thereby supporting the second display portion in tension across the second axial opening.

In particular embodiments, the first groove has a first groove depth and the second groove has a second groove depth. The substrate portion typically has a substrate width and the spacer portion typically has a spacer width which is less than the substrate width. In such an embodiment, the difference between the substrate width and spacer width generally defines the sum of the first and second groove depths. When the meaning of the term "groove depth" cannot be reasonably ascertained by viewing the various figures provided herein, it is generally defined by the distance between the groove floor of the respective groove and the substrate edge disposed outwardly therefrom, rather than the distance between the groove floor and the respective peripheral edge.

In certain embodiments, the spacer portion has a spacer thickness, the first groove has a first groove width which is generally defined by the spacer thickness and the second groove has a second groove width which is generally defined by the spacer thickness. In embodiments, the first groove and the second groove may extend along substantially the entire length of the first peripheral edge and second peripheral edge, respectively.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
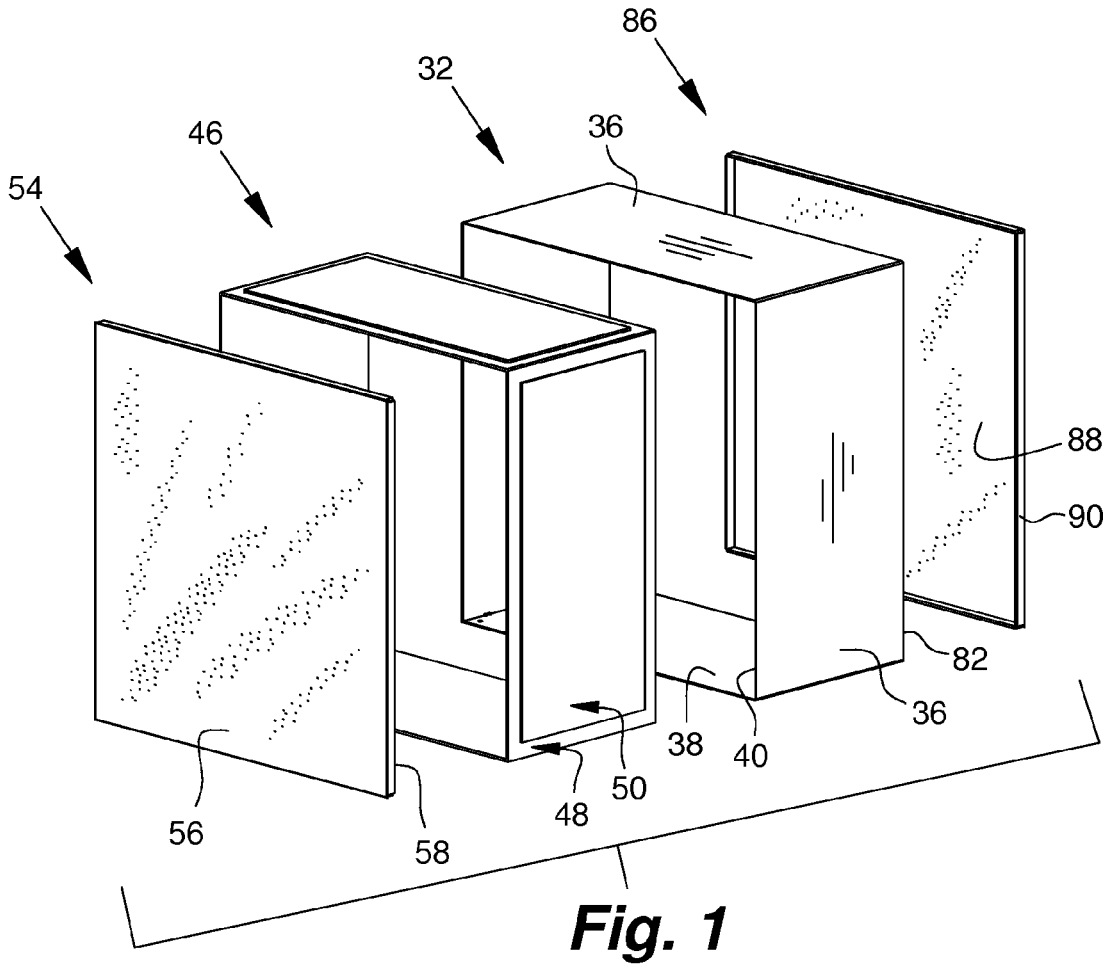
FIG. 1 is a perspective view of a groove-mount fabric display system with two-part frame in accordance with the present invention, in disassembled form.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE INVENTION

Referring now to the drawings, like reference numerals designate identical or corresponding features throughout the several views.

Figure 2:
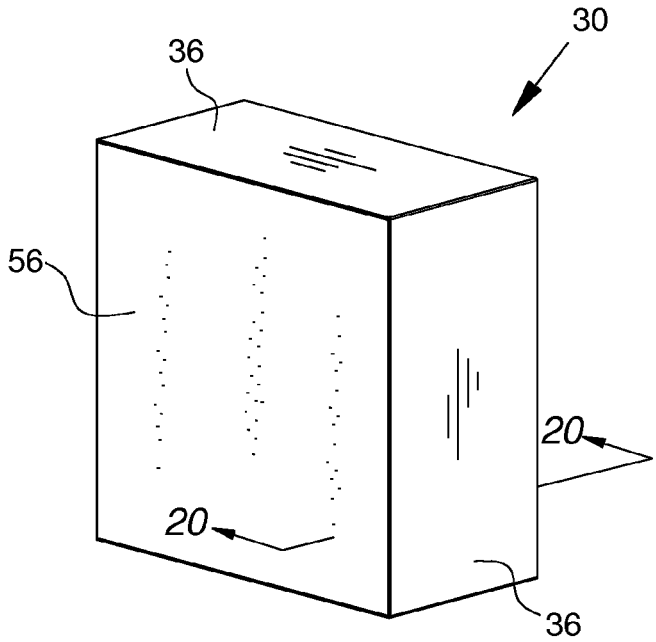
FIG. 2 is a perspective view of a similar embodiment to that depicted in FIG. 1, but in assembled form.
Figure 3:
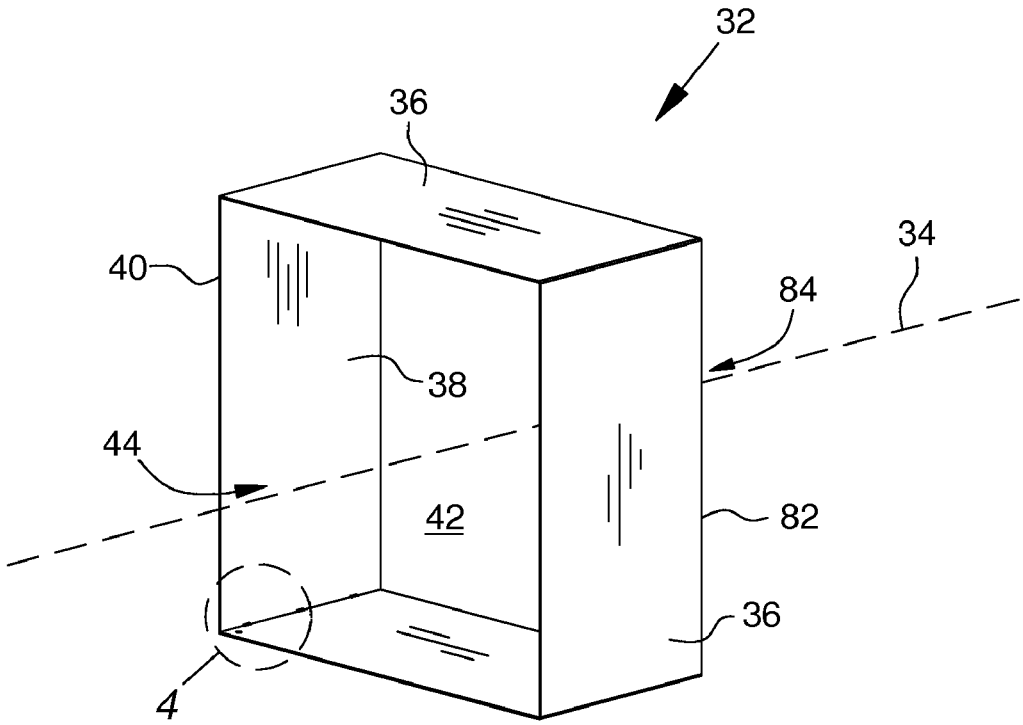
FIG. 3 is a perspective view of an outer frame element in accordance with the present invention.

FIG. 1 depicts a disassembled view of one embodiment of a groove-mount fabric display system with a two-part frame, an assembled version of which is depicted generally at 30 in FIG. 2. The system comprises an outer frame element (shown generally at 32), an insert frame element (shown generally at 46) and at least a first display panel (shown generally at 54). Turning now to FIG. 3 for illustration, the outer frame element 32 has a main axis 34, a multiplicity of sides (such as those shown at 36) distributed thereabout, an inboard surface 38 and a first peripheral edge 40. Depending on the embodiment, the sides 36 can be planar or curved. The sides 36 are thin-walled and generally define the lateral periphery of a cavity 42. In turn, the inboard surface 38 is generally defined by the lateral periphery of the cavity 42. The cavity 42 has a first axial opening 44, and in some embodiments, a second axial opening 84 as well. In embodiments in which the outer frame element 32 has a second axial opening 84, the outer frame element 32 also has a second peripheral edge 82. In typical embodiments, the first and second peripheral edges also define the axial peripheries of the cavity 42.

Figure 5:
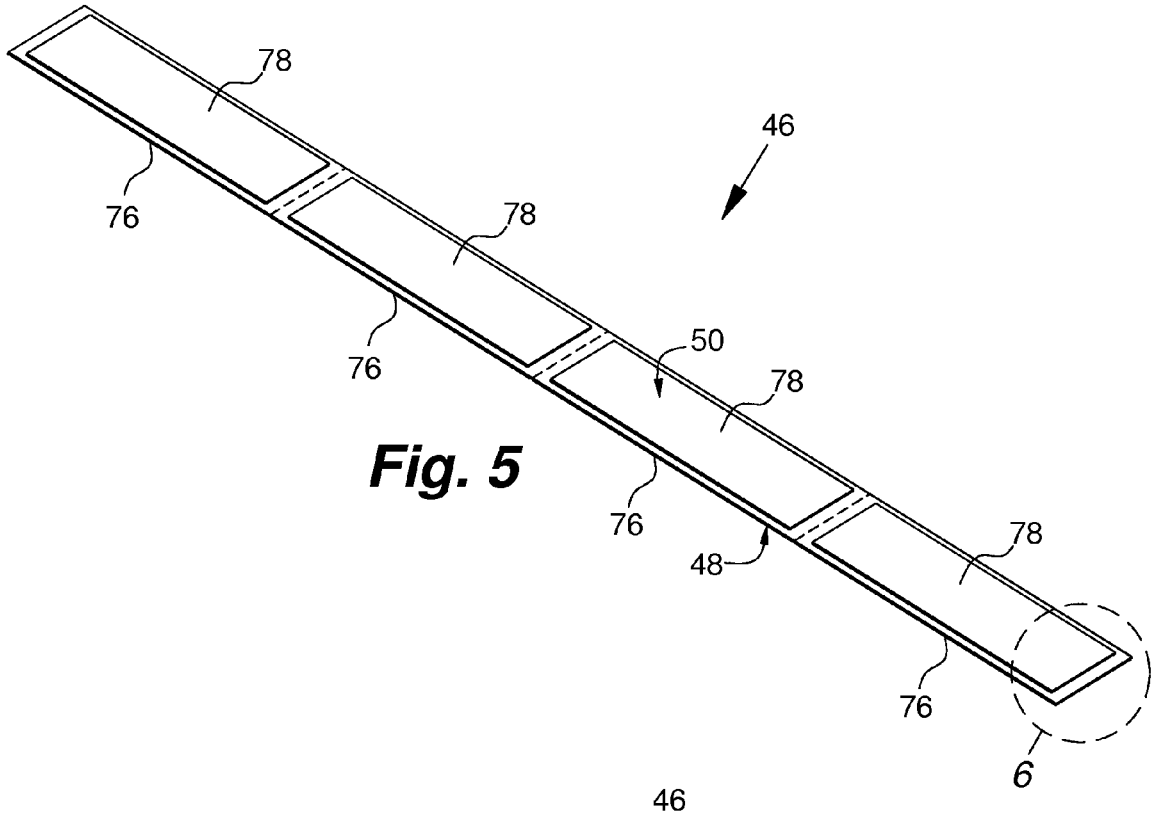
FIG. 5 is a perspective view of an inner frame element in a generally planar precursor configuration, also depicting a spacer portion comprised of a plurality of spacer segments, and a substrate portion comprised of a plurality of substrate segments in hinged association with one another.
Figure 6:
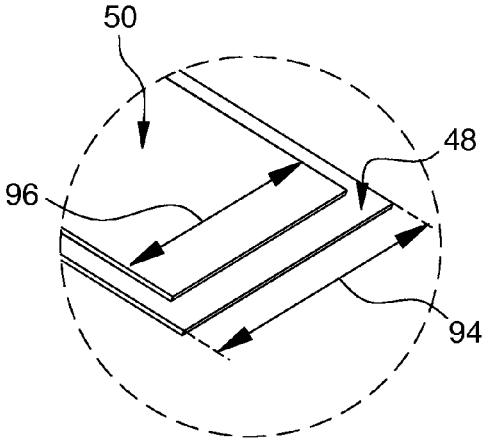
FIG. 6 is a diagrammatic enlarged view of detail 6 of FIG. 5.
Figure 7:
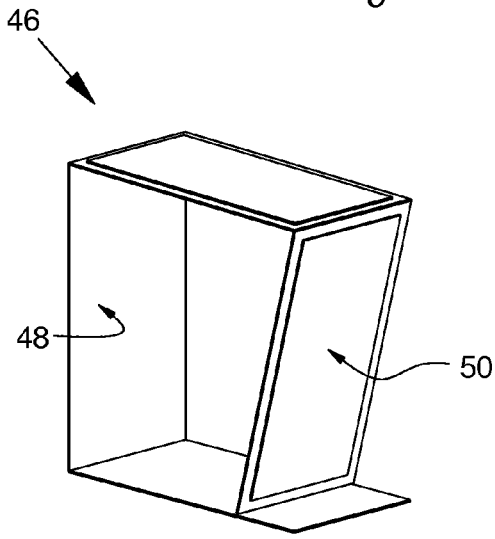
FIG. 7 is an inner frame element similar to that shown in FIG. 5, but in an intermediate configuration within which it can be more easily inserted into the cavity of an outer frame element.
Figure 8:
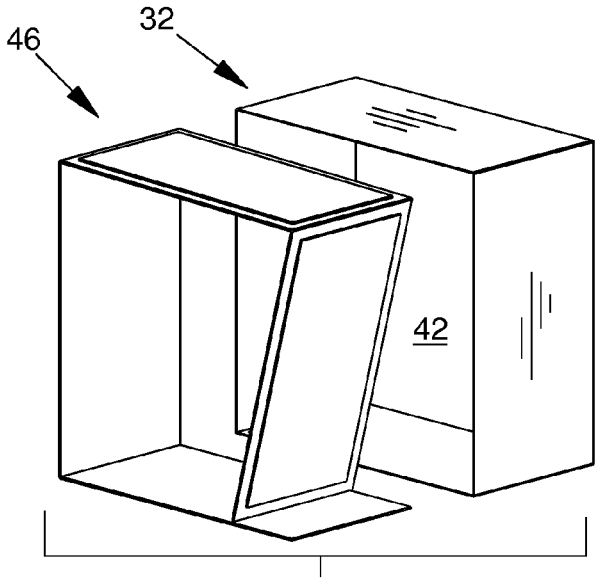
FIG. 8 is a perspective view of an inner frame element and an outer frame element prior to the axial insertion of the inner frame element into the cavity of the outer frame element.
Figure 9:
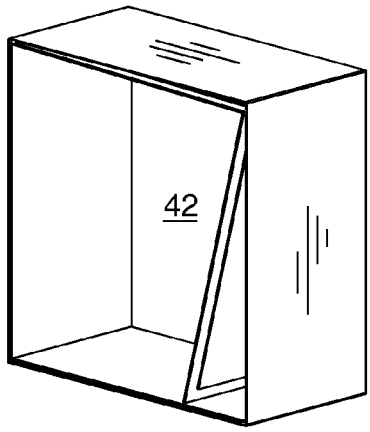
FIG. 9 is a perspective view similar to that of FIG. 8, but in which the inner frame element has been axially inserted into the cavity of the outer frame element.
Figure 10:
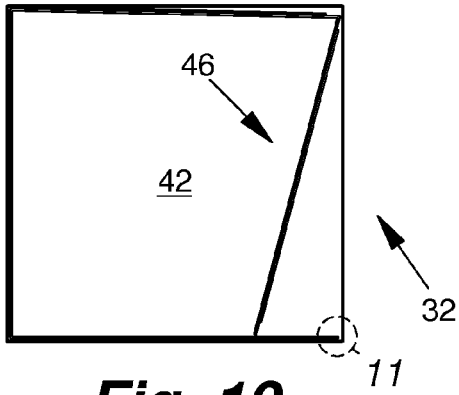
FIG. 10 is a front view of the elements and configuration shown in FIG. 9.
Figure 11:
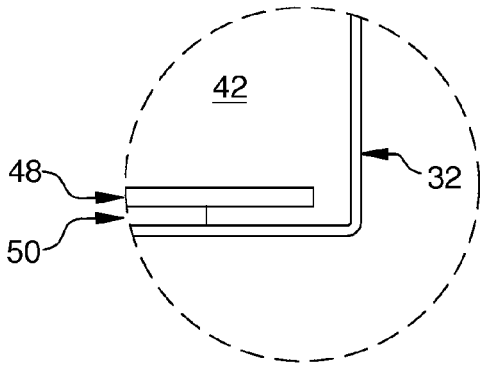
FIG. 11 is a diagrammatic enlarged view of detail 11 of FIG. 10.
Figure 12:
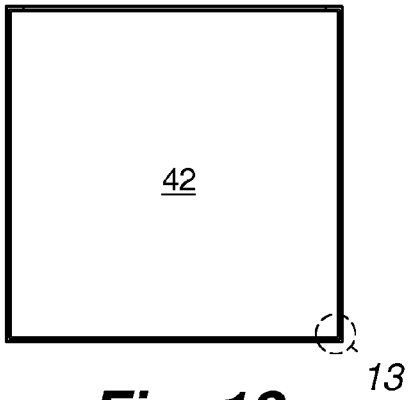
FIG. 12 is a front view of an insert frame element having been axially inserted into an outer frame element and placed in deployed configuration, thereby creating a two-part frame in accordance with the present invention.
Figure 13:
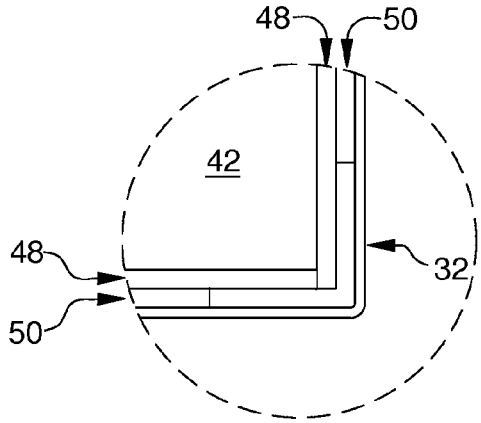
FIG. 13 is a diagrammatic enlarged view of detail 13 of FIG. 12, illustrating how the engagement of the ends of the substrate portion of one embodiment can help lock the inner frame element in deployed configuration.
Figure 14:
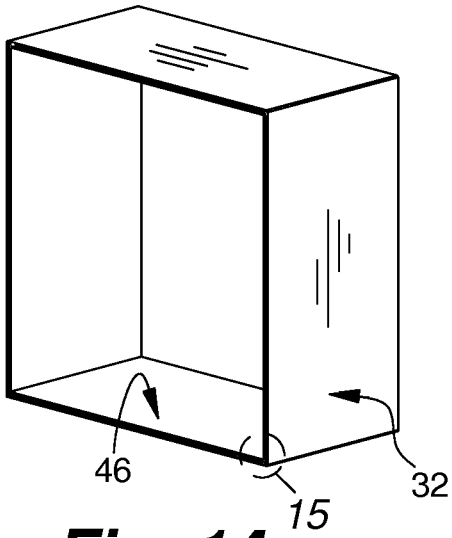
FIG. 14 is a perspective view of a two-part frame similar to that shown in FIG. 12.
Figure 15:
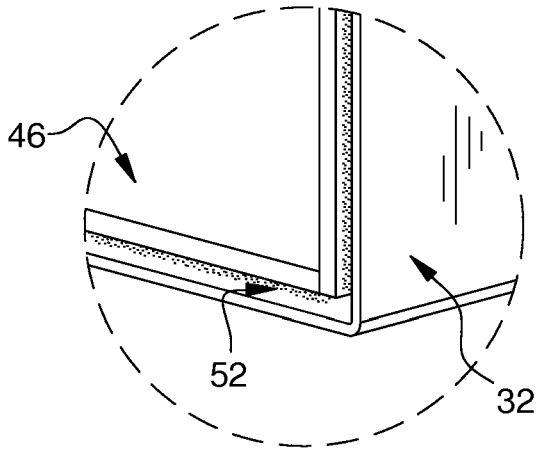
FIG. 15 is a diagrammatic enlarged view of detail 15 of FIG. 14, depicting a first groove formed as a result of an insert frame element being placed in its deployed configuration.

Turning now to FIGS. 5-7 for illustration, the insert frame element 46 has a substrate portion (shown generally at 48), and a spacer portion (shown generally at 50), each typically being thin-walled and in fixed association with each other. The insert frame element 46 is adapted to be axially inserted into the cavity 42 (see, for example, FIGS. 8-11) and placed in a deployed configuration (see, for example, FIGS. 12-15). When the insert frame member 46 is in its deployed configuration, the spacer portion 50 is generally disposed between the substrate portion 48 and the inboard surface 38 of the outer frame element 32, thereby forming a first groove 52 generally proximate the first peripheral edge 40, and, in certain embodiments having a second axial opening 84, forming a second groove (not shown) generally proximate the second peripheral edge 82. The first groove 52 and second groove each open in substantially the axial direction, that is, in a direction generally parallel with the main axis 34 of the outer frame element 32.

Figure 19:
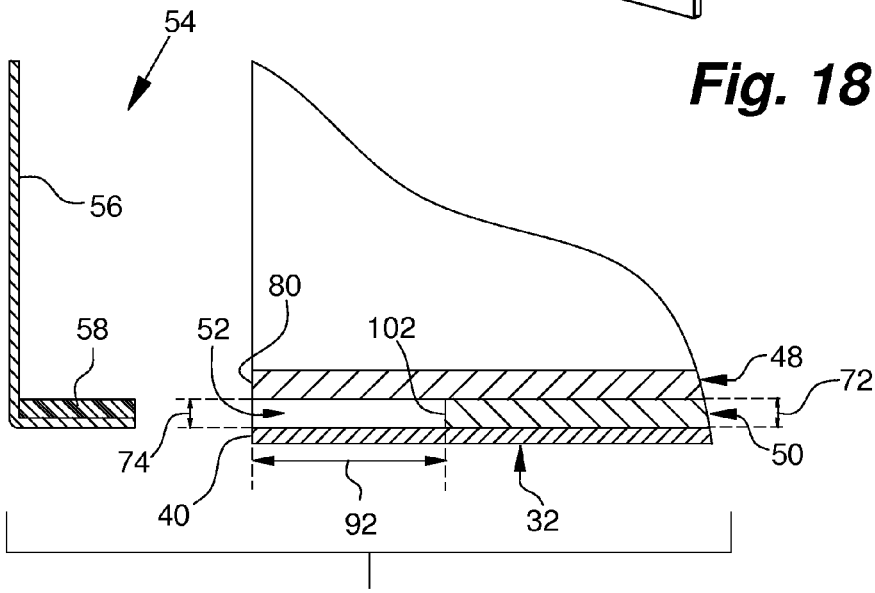
FIG. 19 is a partial cross-sectional view taken along lines 19-19 of FIG. 18, depicting the first mounting gasket prior to insertion into the first groove.
Figure 20:
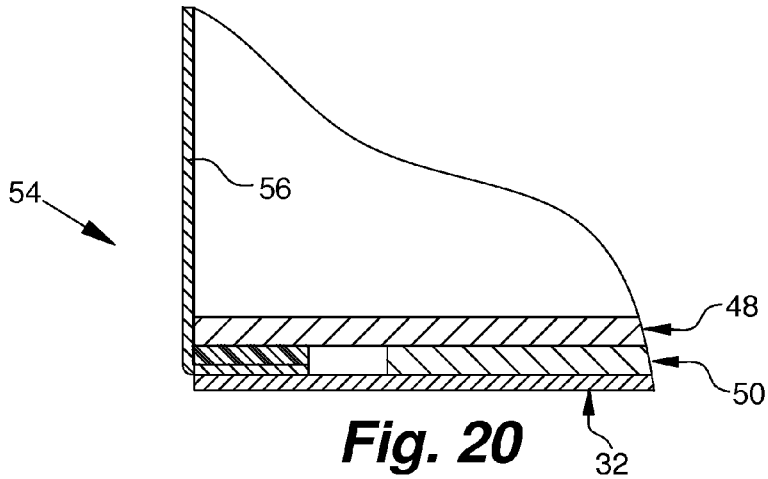
FIG. 20 is a partial cross-sectional view taken along lines 20-20 of FIG. 2, depicting the first mounting gasket inserted into the first groove.

Turning to FIGS. 1, 19 and 20 for illustration, the first display panel 54 has a first display portion 56 and a first mounting gasket 58 flexibly connected thereto. The first display portion 56 is substantially flexible, and can be comprised of fabric or other flexible material suitable for use as a substrate upon which graphics can be mounted, printed or projected. The first mounting gasket 58 is adapted to be inserted into the first groove 52, thereby supporting the first display portion 56 in tension across the first axial opening 44.

Figure 16:
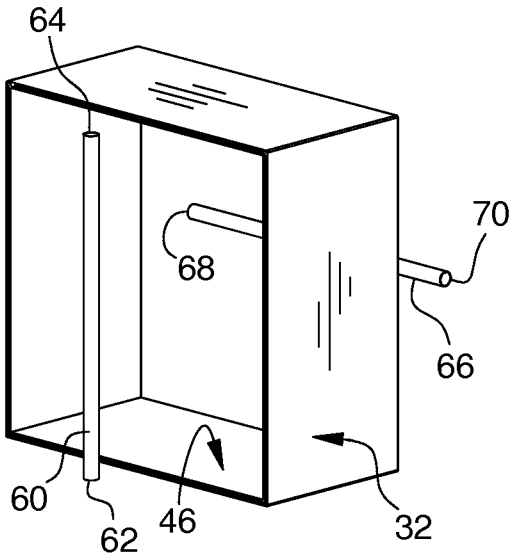
FIG. 16 is a perspective view of a two-part frame in accordance with the present invention in which the insert frame element has been placed in deployed configuration, and first and second compression tubes are shown prior to their being snugly positioned within the cavity of the outer frame element.
Figure 17:
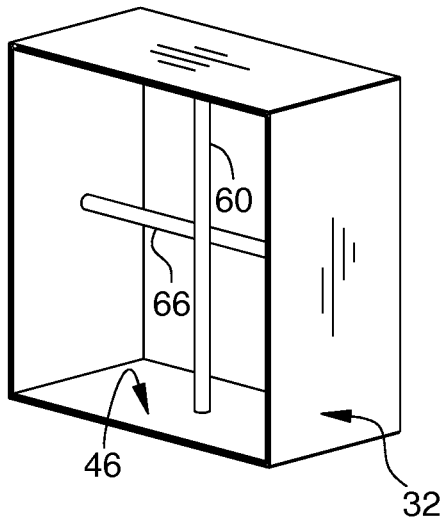
FIG. 17 is a perspective view of a two-part frame similar to that shown in FIG. 16, but in which first and second compression tubes have been snugly inserted into the cavity such that their respective ends continuously urge the inner frame element toward the inboard surface of the outer frame element.

Turning now to FIGS. 16 and 17 for illustration, certain embodiments further comprise a first compression tube 60, which is generally elongated with two first opposed ends 62 and 64. The first compression tube 60 is adapted to be snugly positioned within the cavity 42 such that one or both first opposed ends 62 and 64 continuously urge the inner frame element 46 toward the inboard surface 38. Embodiments with a first compression tube 60 may also comprise a second compression tube 66 which is elongated with two second opposed ends 68 and 70. The second compression tube 66 is adapted to be snugly positioned within the cavity 42, typically at approximately a right angle to the first compression tube 60 such that one or both second opposed ends 68 and 70 continuously urge the inner frame element 46 toward the inboard surface 38. To provide further aid in urging the inner frame element 46 toward the inboard surface 38, additional such compression tubes may be used. The compression tubes described herein can be positioned in parallel or at various angles with respect to each other. Although the compression tubes depicted in the various figures have circular cross-sections, compression tubes in accordance with the present invention can have cross-sections of different shapes as well. Further, the compression tubes are preferably made of lightweight and inexpensive materials such as cardboard and the like, can be either hollow or solid, and in some cases can be curved or bent.

Turning now to FIGS. 19 and 20 for illustration, in embodiments, the spacer portion 50 typically has a spacer thickness 72. The first groove 52 and second groove (not shown) have a first groove width 74 and second groove width (not shown), respectively. In certain embodiments, such as the one illustrated in FIGS. 19 and 20, the first and second groove widths may be defined by the spacer thickness 72. In addition, the first and second grooves of particular embodiments extend along substantially the entire length of the first peripheral edge 40 and second peripheral edge 82, respectively. As a result, the first and second grooves may be continuous, tracing around the entire lateral periphery of the cavity 42.

Figure 4:
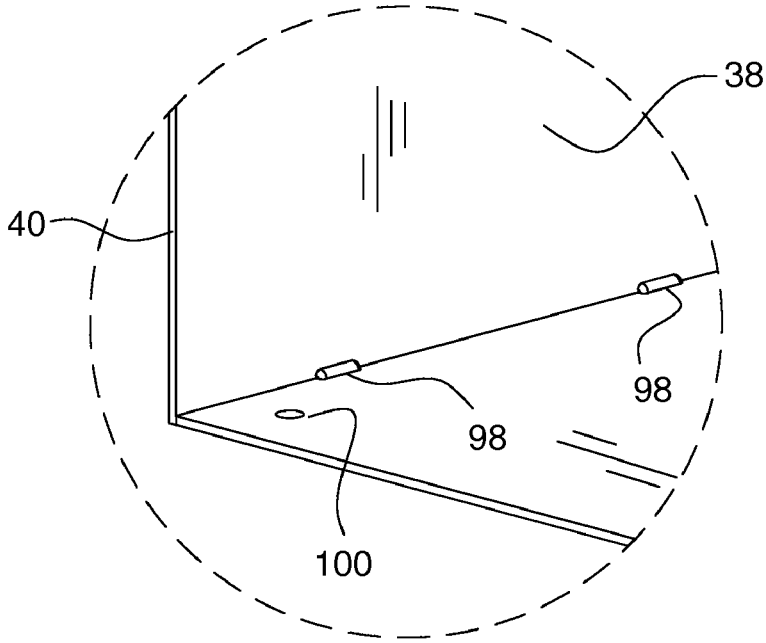
FIG. 4 is a diagrammatic enlarged view of detail 4 of FIG. 3.

In most embodiments, the outer frame element 32 is substantially formed of flat stock of a material such as metal and plastic. By using flat stock metal, for example, an outer frame element 32 can be formed inexpensively by way of simple, conventional metal-forming processes. Such processes can create a series of corner bends in the flat stock to produce the desired size and number of sides. As a result, an outer frame element 32 can be formed into shapes such as triangles, squares, octagons or other multi-sided contours. Conventional metal-forming operations can also be used to produce curved sides when desired. As illustrated in FIGS. 3 and 4, the contour of the outer frame element 32 can then be permanently closed using, for example, a simple adhesive or welding operation (see example welding beads at 98) at a single joint. The outer frame element may then be suspended by way of, for example, a small through-hole 100 for priming, painting and drying purposes. What results from the described forming and finishing processes is an inexpensive, structurally rigid and visually attractive outer frame element 32.

Typically, the insert frame element 46 is substantially formed of a material such as wood, cardboard, light-gauge plastic or sheet metal. The substrate portion 48 and spacer portion 50 can be made from the same or different materials, and in most embodiments, are fixedly associated with one another by way of, for example, an adhesive operation or by having been integrally formed with one another.

Turning now to FIGS. 5 and 7 for illustration, in particular embodiments the substrate portion 48 is comprised of a plurality of substrate segments 76 in hinged association with one another. In such embodiments, each substrate segment 76 typically corresponds to a separate side 36 of the outer frame element 32. The hinged association generally allows the insert frame element 46 to be moved between a generally planar precursor configuration (as depicted, for example, in FIG. 5) and the aforementioned deployed configuration (see, for example, FIGS. 14 and 15). This hinged association can be created by, for example, living hinges inexpensively formed in cardboard or plastic stock from which the substrate portion 48 may be made. Returning to FIG. 5 for illustration, it is also common in embodiments with a plurality of substrate segments 76 for the spacer portion 50 to be comprised of a plurality of spacer segments 78, each spacer segment 78 corresponding to a separate substrate segment 76. Similarly, the first mounting gasket 58 may be comprised of a plurality of first gasket segments (not shown in detail), each typically corresponding to a separate side 36 of the outer frame element 32. The second mounting gasket 90 may similarly be comprised of a plurality of second gasket segments (not shown in detail).

Figure 18:
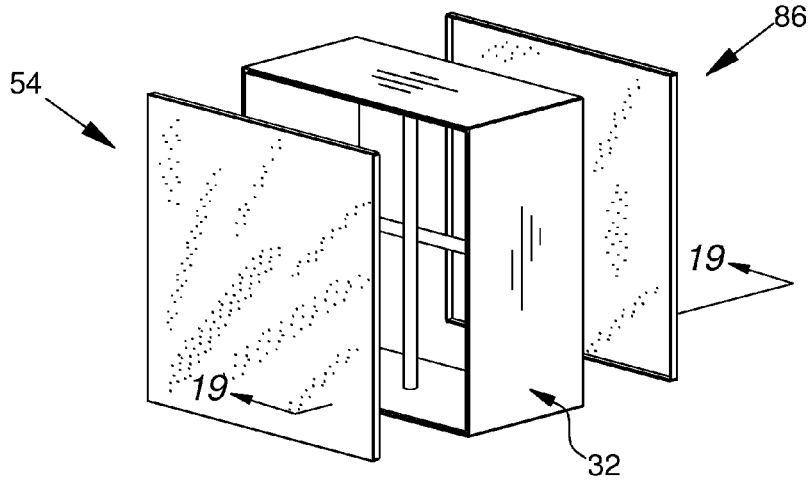
FIG. 18 is a perspective view of a further embodiment of a groove-mount fabric display system with two-part frame in accordance with the present invention in partially disassembled form, showing a two-part frame which includes two compression tubes as components of the inner part of the frame, and first and second display panels prior to their being attached to the two-part frame.

Turning to FIG. 3, in certain embodiments in which the outer frame member 32 has a second peripheral edge 82, the cavity 42 has a second axial opening 84, and a second groove (not shown) is formed when the insert frame element 46 is in deployed configuration (see, for example, FIGS. 12-15), the embodiment may also comprise a second display panel 86 (see, for example, FIGS. 1 and 18). The second display panel 86 has a second display portion 88 and a second mounting gasket 90 flexibly connected thereto. The second display portion 88 is substantially flexible, and can be comprised of fabric or other flexible material suitable for use as a substrate upon which graphics can be mounted, printed or projected. The second mounting gasket 90 is adapted to be inserted into the second groove (not shown), thereby supporting the second display portion 88 in tension across the second axial opening 84.

Turning to FIGS. 19 and 20 for illustration, in particular embodiments, the first groove 52 has a first groove depth 92 and the second groove has a second groove depth (not shown). Referring to FIG. 6 for illustration, the substrate portion 48 typically has a substrate width 94 and the spacer portion 50 typically has a spacer width 96 which is less than the substrate width 94. In such an embodiment, the difference between the substrate width 94 and spacer width 96 generally defines the sum of the first and second groove depths. Returning to FIG. 19 for illustration, when the meaning of the term "groove depth" cannot be reasonably ascertained by viewing the various figures provided herein, it is generally defined by the distance between the groove floor 102 of the respective groove and the substrate edge 80 disposed outwardly therefrom, rather than the distance between the groove floor 102 and the respective peripheral edge (such as first peripheral edge 40). This is a particularly important distinction in embodiments in which one or both display panels are intended to be mounted so that they are slightly inset from the respective peripheral edges of the outer frame element.

Returning to FIG. 19 for illustration, in certain embodiments, the spacer portion 50 has a spacer thickness 72 which defines the first groove width 74 of the first groove 52 and the second groove width of the second groove.

The detailed description of embodiments of the groove-mount fabric display system with two-part frame is intended merely to provide examples, and is in no way intended to limit the scope of the appended claims to these described embodiments. Accordingly, modifications to the embodiments described are possible, and it should be clearly understood that the invention may be practiced in many different ways than the embodiments specifically described below, and still remain within the scope of the claims.

What is claimed is:

1. A groove-mount fabric display system comprising:

(a) an outer frame element having a main axis, a multiplicity of sides distributed thereabout, an inboard surface and a first peripheral edge, said sides being thin-walled and generally defining the lateral periphery of a cavity, said cavity having a first axial opening;

(b) an insert frame element having a substrate portion and a spacer portion, said insert frame element being adapted to be axially inserted into said cavity and placed in a deployed configuration wherein said spacer portion is generally disposed between said substrate portion and said inboard surface, thereby forming a first groove generally proximate said first peripheral edge, said first groove opening in substantially the axial direction;

(c) a first display panel having a first display portion and a first mounting gasket flexibly connected thereto, said first display portion being substantially flexible, said first mounting gasket being adapted to be inserted into said first groove, thereby supporting said first display portion in tension across said first axial opening; and (d) a first compression tube, said first compression tube being elongated with two first opposed ends, said first compression tube being adapted to be snugly positioned within said cavity such that one or both said first opposed ends continuously urge said inner frame element toward said inboard surface.

2. A groove-mount fabric display system as defined in claim 1 further comprising a second compression tube, said second compression tube being elongated with two second opposed ends, said second compression tube being adapted to be snugly positioned within said cavity at approximately a right angle to said first compression tube such that one or both said second opposed ends continuously urge said inner frame element toward said inboard surface.

3. A groove-mount fabric display system comprising:

(a) an outer frame element having a main axis, a multiplicity of sides distributed thereabout, an inboard surface and a first peripheral edge, said sides being thin-walled and generally defining the lateral periphery of a cavity, said cavity having a first axial opening;

(b) an insert frame element having a substrate portion and a spacer portion, said insert frame element being adapted to be axially inserted into said cavity and placed in a deployed configuration wherein said spacer portion is generally disposed between said substrate portion and said inboard surface, thereby forming a first groove generally proximate said first peripheral edge, said first groove opening in substantially the axial direction; and (c) a first display panel having a first display portion and a first mounting gasket flexibly connected thereto, said first display portion being substantially flexible, said first mounting gasket being adapted to be inserted into said first groove, thereby supporting said first display portion in tension across said first axial opening;

wherein:

(i) said substrate portion is comprised of a plurality of substrate segments in hinged association with one another, each said substrate segment corresponding to a separate said side, said hinged association allowing said insert frame element to be moved between a generally planar precursor configuration and said deployed configuration;

(ii) said spacer portion is comprised of a plurality of spacer segments, each said spacer segment corresponding to a separate said substrate segment; and (iii) said first mounting gasket is comprised of a plurality of first gasket segments, each said first gasket segment corresponding to a separate said side.

4. A groove-mount fabric display system comprising:

(a) an outer frame element having a main axis, a multiplicity of sides distributed thereabout, an inboard surface, a first peripheral edge and a second peripheral edge, said sides being thin-walled and generally defining the lateral periphery of a cavity, said cavity having a first axial opening and a second axial opening;

(b) an insert frame element having a substrate portion and a spacer portion, said insert frame element being adapted to be axially inserted into said cavity and placed in a deployed configuration wherein said spacer portion is generally disposed between said substrate portion and said inboard surface, thereby forming a first groove generally proximate said first peripheral edge and a second groove generally proximate said second peripheral edge, said first groove and said second groove each opening in substantially the axial direction;

(c) a first display panel having a first display portion and a first mounting gasket flexibly connected thereto, said first display portion being substantially flexible, said first mounting gasket being adapted to be inserted into said first groove, thereby supporting said first display portion in tension across said first axial opening;

(d) a second display panel having a second display portion and a second mounting gasket flexibly connected thereto, said second display portion being substantially flexible, said second mounting gasket being adapted to be inserted into said second groove, thereby supporting said second display portion in tension across said second axial opening;

(e) a first compression tube, said first compression tube being elongated with two first opposed ends, said first compression tube being adapted to be snugly positioned within said cavity such that one or both said first opposed ends continuously urge said inner frame element toward said inboard surface; and (f) a second compression tube, said second compression tube being elongated with two second opposed ends, said second compression tube being adapted to be snugly positioned within said cavity at approximately a right angle to said first compression tune such that one or both said second opposed ends continuously urge said inner frame element toward said inboard surface.

5. A groove-mount fabric display system comprising:

(a) an outer frame element having a main axis, a multiplicity of sides distributed thereabout, an inboard surface, a first peripheral edge and a second peripheral edge, said sides being thin-walled and generally defining the lateral periphery of a cavity, said cavity having a first axial opening and a second axial opening;

(b) an insert frame element having a substrate portion and a spacer portion, said insert frame element being adapted to be axially inserted into said cavity and placed in a deployed configuration wherein said spacer portion is generally disposed between said substrate portion and said inboard surface, thereby forming a first groove generally proximate said first peripheral edge and a second groove generally proximate said second peripheral edge, said first groove and said second groove each opening in substantially the axial direction;

(c) a first display panel having a first display portion and a first mounting gasket flexibly connected thereto, said first display portion being substantially flexible, said first mounting gasket being adapted to be inserted into said first groove, thereby supporting said first display portion in tension across said first axial opening; and (d) a second display panel having a second display portion and a second mounting gasket flexibly connected thereto, said second display portion being substantially flexible, said second mounting gasket being adapted to be inserted into said second groove, thereby supporting said second display portion in tension across said second axial opening;

wherein:

(i) said first groove has a first groove depth;

(ii) said second groove has a second groove depth;

(iii) said substrate portion has a substrate width;

(iv) said spacer portion has a spacer width, said spacer width being less than said substrate width; and (v) the difference between said substrate width and said spacer width generally defines the sum of said first and second groove depths.

6. A groove-mount fabric display system comprising:

(a) an outer frame element having a main axis, four sides distributed thereabout, an inboard surface, a first peripheral edge and a second peripheral edge, said sides being thin-walled, generally planar and generally defining the lateral periphery of a cavity, said cavity having a first axial opening and a second axial opening;

(b) an insert frame element having a substrate portion and a spacer portion, said spacer portion having a spacer thickness, said insert frame element being adapted to be axially inserted into said cavity and placed in a deployed configuration wherein said spacer portion is generally disposed between said substrate portion and said inboard surface, thereby forming a first groove generally proximate said first peripheral edge and a second groove generally proximate said second peripheral edge, said first groove having a first groove width which is generally defined by said spacer thickness, said second groove having a second groove width which is generally defined by said spacer thickness, said first groove and said second groove each opening in substantially the axial direction and extending along substantially the entire length of said first peripheral edge and said second peripheral edge, respectively;

(c) a first display panel having a first display portion and a first mounting gasket flexibly connected thereto, said first display portion being comprised of fabric, said first mounting gasket being adapted to be inserted into said first groove, thereby supporting said first display portion in tension across said first axial opening; and (d) a second display panel having a second display portion and a second mounting gasket flexibly connected thereto, said second display portion being comprised of fabric, said second mounting gasket being adapted to be inserted into said second groove, thereby supporting said second display portion in tension across said second axial opening;

wherein:

(i) said substrate portion and said spacer portion are each thin-walled;

(ii) said substrate portion is comprised of four substrate segments in hinged association with one another, said hinged association allowing said insert frame element to be moved between a generally planar precursor configuration and said deployed configuration;

(iii) said spacer portion is comprised of a plurality of spacer segments, each said spacer segment corresponding to a separate said substrate segment;

(iv) said first mounting gasket is comprised of a plurality of first gasket segments, each said first gasket segment corresponding to a separate said side; and (v) said second mounting gasket is comprised of a plurality of second gasket segments, each said second gasket segment corresponding to a separate said side.

7. A groove-mount fabric display system comprising:

(a) an outer frame element having a main axis, four sides distributed thereabout, an inboard surface, a first peripheral edge and a second peripheral edge, said sides being thin-walled, generally planar and generally defining the lateral periphery of a cavity, said cavity having a first axial opening and a second axial opening;

(b) an insert frame element having a substrate portion and a spacer portion, said spacer portion having a spacer thickness, said insert frame element being adapted to be axially inserted into said cavity and placed in a deployed configuration wherein said spacer portion is generally disposed between said substrate portion and said inboard surface, thereby forming a first groove generally proximate said first peripheral edge and a second groove generally proximate said second peripheral edge, said first groove having a first groove width which is generally defined by said spacer thickness, said second groove having a second groove width which is generally defined by said spacer thickness, said first groove and said second groove each opening in substantially the axial direction and extending along substantially the entire length of said first peripheral edge and said second peripheral edge, respectively;

(c) a first display panel having a first display portion and a first mounting gasket flexibly connected thereto, said first display portion being comprised of fabric, said first mounting gasket being adapted to be inserted into said first groove, thereby supporting said first display portion in tension across said first axial opening;

(d) a second display panel having a second display portion and a second mounting gasket flexibly connected thereto, said second display portion being comprised of fabric, said second mounting gasket being adapted to be inserted into said second groove, thereby supporting said second display portion in tension across said second axial opening;

(e) a first compression tube, said first compression tube being elongated with two first opposed ends, said first compression tube being adapted to be snugly positioned within said cavity such that one or both said first opposed ends continuously urge said inner frame element toward said inboard surface; and (f) a second compression tube, said second compression tube being elongated with two second opposed ends, said second compression tube being adapted to be snugly positioned within said cavity at approximately a right angle to said first compression tube such that one or both said second opposed ends continuously urge said inner frame element toward said inboard surface.

* * * * *